US008816591B2

(12) United States Patent
Chu et al.

(10) Patent No.: US 8,816,591 B2
(45) Date of Patent: Aug. 26, 2014

(54) METHODS AND APPARATUS FOR SEGMENTING AND DRIVING LED-BASED LIGHTING UNITS

(75) Inventors: Hung-Chi Chu, Kaohsiung (TW); Yuh-Ren Shen, Tainan (TW)

(73) Assignee: VastView Technology Inc., Hsinchu County (TW)

( * ) Notice: Subject to any disclaimer, the term of this patent is extended or adjusted under 35 U.S.C. 154(b) by 241 days.

(21) Appl. No.: 13/481,796

(22) Filed: May 26, 2012

(65) Prior Publication Data

US 2013/0313987 A1 Nov. 28, 2013

(51) Int. Cl.
*H05B 37/02* (2006.01)

(52) U.S. Cl.
USPC ..... 315/193; 315/297; 315/291

(58) Field of Classification Search
None
See application file for complete search history.

(56) References Cited

U.S. PATENT DOCUMENTS

| | | | | |
|---|---|---|---|---|
| 6,153,980 | A * | 11/2000 | Marshall et al. | 315/200 A |
| 6,621,235 | B2 * | 9/2003 | Chang | 315/216 |
| 6,636,003 | B2 * | 10/2003 | Rahm et al. | 315/179 |
| 6,680,579 | B2 * | 1/2004 | Allen et al. | 315/169.3 |
| 6,777,891 | B2 | 8/2004 | Lys et al. | |
| 6,897,624 | B2 * | 5/2005 | Lys et al. | 315/297 |
| 6,989,807 | B2 | 1/2006 | Chiang | |
| 7,064,498 | B2 * | 6/2006 | Dowling et al. | 315/291 |
| 7,781,979 | B2 * | 8/2010 | Lys | 315/185 S |
| 8,174,212 | B2 | 5/2012 | Tziony et al. | |
| 8,203,284 | B2 * | 6/2012 | Peeters et al. | 315/299 |
| 8,207,685 | B2 * | 6/2012 | Cheng et al. | 315/306 |
| 8,339,049 | B2 * | 12/2012 | Kang et al. | 315/185 R |
| 8,344,633 | B2 * | 1/2013 | Van Woudenberg et al. | 315/186 |
| 8,436,553 | B2 * | 5/2013 | Zampini et al. | 315/291 |
| 2003/0057884 | A1 * | 3/2003 | Dowling et al. | 315/291 |
| 2005/0116665 | A1 * | 6/2005 | Colby et al. | 315/291 |
| 2005/0253533 | A1 * | 11/2005 | Lys et al. | 315/224 |
| 2007/0236156 | A1 * | 10/2007 | Lys et al. | 315/291 |
| 2008/0012506 | A1 * | 1/2008 | Mueller et al. | 315/294 |
| 2008/0068298 | A1 | 3/2008 | Shen et al. | |
| 2008/0191642 | A1 * | 8/2008 | Slot et al. | 315/295 |
| 2009/0284172 | A1 * | 11/2009 | Maschietto et al. | 315/294 |
| 2010/0308739 | A1 | 12/2010 | Shteynberg et al. | |

FOREIGN PATENT DOCUMENTS

| | | | |
|---|---|---|---|
| TW | 201127197 | A | 8/2011 |
| TW | 201143515 | A | 12/2011 |
| WO | 2012026216 | A1 | 3/2012 |

* cited by examiner

*Primary Examiner* — Crystal L Hammond
(74) *Attorney, Agent, or Firm* — Lin & Associates IP, Inc.

(57) ABSTRACT

A plurality of LED-based lighting units is segmented into a plurality of LED-based lighting segments connected in series. Each lighting segment has a plurality of LED-based lighting units connected in series with at least a series-connection switch, and a bypass-connection switch is connected in parallel with the series of LED-based lighting units. The total number of LED-based lighting units can be determined by a maximum voltage level of an input voltage supply and the forward voltage of the LED-based lighting unit for achieving optimal efficiency. The number of lighting segments and the number of lighting units in each lighting segment are properly chosen based on the total number of the LED-based lighting units in such away that any number up to the total number of all the LED-based lighting units can be connected in series by respectively controlling the series-connection switch and the bypass-connection switch of each LED-based lighting segment.

30 Claims, 10 Drawing Sheets

METHODS AND APPARATUS FOR SEGMENTING AND DRIVING LED-BASED LIGHTING UNITS

BACKGROUND OF THE INVENTION

1. Field of the Invention

The present invention relates generally to LED-based lighting apparatus, and more particularly to methods and apparatus for segmenting and driving a plurality of LED-based lighting units to improve the efficiency of the lighting apparatus.

2. Description of Related Arts

Light emitting diodes (LEDs) are semiconductor-based light sources often employed in low-power instrumentation and appliance applications for indication purposes. The application of LEDs in various lighting units has become more and more popular. For example, high brightness LEDs have been widely used for traffic lights, vehicle indicating lights, and braking lights.

An LED has an I-V characteristic curve similar to an ordinary diode. When the voltage applied to the LED is less than a forward voltage, only very small current flows through the LED. When the voltage exceeds the forward voltage, the current increases sharply. The output luminous intensity of an LED light is approximately proportional to the LED current for most operating values of the LED current except for the high current value. A typical driving device for an LED light is designed to provide a constant current for stabilizing light emitted from the LED and extending the life of the LED.

In order to increase the brightness of an LED light, a number of LEDs are usually connected in series to form an LED-based lighting unit and a number of LED-based lighting units may further be connected in series to form a lighting apparatus. For example, U.S. Pat. No. 6,777,891 discloses a plurality of LED-based lighting units as a computer-controllable light string with each lighting unit forming an individually-controllable node of the light string.

The operating voltage required by each lighting unit typically is related to the forward voltage of the LEDs in each lighting unit, how many LEDs are employed for each of the lighting unit and how they are interconnected, and how the respective lighting units are organized to receive power from a power source. Accordingly, in many applications, some type of voltage conversion device is required in order to provide a generally lower operating voltage to one or more LED-based lighting units from more commonly available higher power supply voltages. The need of a voltage conversion device reduces the efficiency, costs more and also makes it difficult to miniaturize an LED-based lighting device.

U.S. Pat. No. 7,781,979 provides an apparatus for controlling series-connected LEDs. Two or more LEDs are connected in series. A series current flows through the LEDs when an operating voltage is applied. One or more controllable current paths are connected in parallel with at least an LED for partially diverting the series current around the LED. The apparatus permits the use of operating voltages such as 120V AC or 240V AC without requiring a voltage conversion device.

US Pat. Publication No. 2010/0308739 discloses a plurality of LEDs coupled in series to form a plurality of segments of LEDs and a plurality of switches coupled to the plurality of segments of LEDs to switch a selected segment into or out of a series LED current path in response to a control signal. FIG. 1 shows a simplified block diagram of an LED lighting apparatus, which has 3 segments of LEDs respectively including 1, 2 and 4 LEDs for connecting 1 to 7 LEDs in series, disclosed in the publication.

As more and more LED-based lighting units are used in high brightness lighting equipment, there is a strong need to design methods and apparatus that can drive and connect the LED-based lighting units intelligently and efficiently to increase the utilization of the LEDs and provide stable and high brightness by using the readily available AC source from a wall power unit. In addition, it is also highly desirable to provide many different lighting modes for the connected LED-based lighting units so that the brightness can be controlled properly according to different lighting requirements or the variation of the voltage level of the AC source.

SUMMARY OF THE INVENTION

The present invention has been made to meet the above mentioned needs in the application of LED-based lighting units. A primary object of the present invention is to provide an apparatus that can flexibly connect a plurality of LED-based lighting units by segmenting the plurality of LED-based lighting units in such a way that each of the LED-based lighting segments may be connected in series or bypassed.

Accordingly, the apparatus of the present invention comprises a plurality of LED-based lighting segments controlled by a controller. Each LED-based lighting segment has one or more LED-based lighting units and at least one switch connected in series. A bypass switch is further connected in parallel with the series of LED-based lighting units in each LED-based lighting segment that can be controlled to connect with other LED-based lighting segments in series, or be bypassed. An input voltage supply is connected to the first LED-based lighting segment to supply power to the apparatus and a current control device connects the last LED-based lighting segment to ground.

Another object of the present invention is to provide an apparatus for controlling the connection of the plurality of LED-based lighting segments according to the voltage level of the input voltage supply or the voltage level across the current control device, or the voltage levels of both of them. In the preferred embodiments of the present invention, the current control device may be a current sensing resistor or a variable current source. In some preferred embodiment, it is also desirable to connect a separate LED-based lighting unit in series with the plurality of LED-based lighting segments.

It is also an object of the present invention to provide various methods for segmenting and driving the LED-based lighting units in order to provide multiple lighting modes by connecting some of the LED-based lighting segments in series and bypassing the remaining LED-based lighting segments. In one exemplary method, one or more LED-based lighting segments can be combined to provide all of possible lighting modes for connecting one or more LED-based lighting units up to all the available LED-based lighting units in series. In an alternative exemplary method, a majority although not all of possible lighting modes can be provided.

Accordingly, the apparatus of the present invention is segmented into a plurality of LED-based lighting segments by allocating each segment with different number of LED-based lighting units connected in series. The number of LED-based lighting segments and the number of LED-based lighting units in each segment are properly determined in such a way that the apparatus can be operated with any number up to the total number of all available LED-based lighting units being connected in series.

In an alternative embodiment, the apparatus of the present invention is also segmented into a plurality of LED-based lighting segments by allocating each segment with different number of LED-based lighting units connected in series. However, the apparatus has less flexibility and can be operated with most but not all of the numbers up to the total number of all available LED-based lighting units being connected in series.

BRIEF DESCRIPTION OF THE DRAWINGS

The present invention will be apparent to those skilled in the art by reading the following detailed description of preferred embodiments thereof, with reference to the attached drawings, in which.

DETAILED DESCRIPTION OF THE PREFERRED EMBODIMENT

Figure 1:
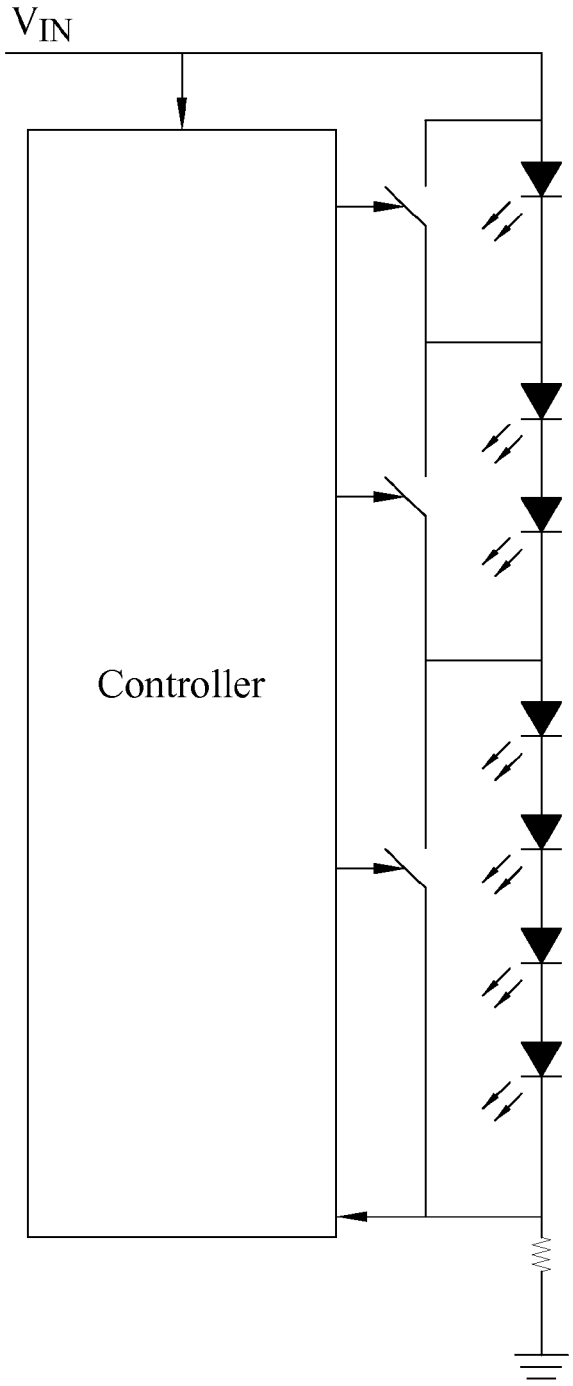
FIG. 1 (Prior Art)
FIG. 1 shows a circuit block diagram of a plurality of LEDs connected in series to form a plurality of segments of LEDs in the prior art.

The accompanying drawings are included to provide a further understanding of the invention, and are incorporated in and constitute a part of this specification. The drawing illustrates embodiments of the invention and, together with the description, serves to explain the principles of the invention.

As mentioned above, in order to increase the brightness of an LED-based lighting apparatus, a number of LED lighting units each having one or more LEDs are usually connected in series to generate more luminous intensity. It is often desirable to provide the LED-based lighting apparatus with multiple lighting modes so that different luminous intensity levels can be provided. A straightforward approach is using a switching device for each LED-based lighting unit so that the LED-based lighting unit can be bypassed or serially connected. However, this approach is not practical because it requires very high hardware cost.

According to the present invention, a novel method is provided for controlling the LED-based lighting apparatus with optimal efficiency. The novel method segments all the available LED-based lighting units into a plurality of segments. Each segment forms an LED-based lighting segment comprising one or more LED-based lighting units connected in series. In the LED-based lighting apparatus, each LED-based lighting segment can be separately controlled. For simplicity, the following description assumes that each LED-based lighting unit has only one LED.

By properly selecting the number of LED-based lighting segments and the number of LEDs in each lighting segment, an LED-based lighting apparatus having a plurality of LEDs can be segmented into an appropriate number of LED-based lighting segments in such a way that the LED-based lighting apparatus can be operated with the most number of lighting modes with the available LEDs. In each lighting mode, a number of LEDs can be connected in series by combining the LED-based lighting segments that are either connected in series or bypassed.

Figure 2:
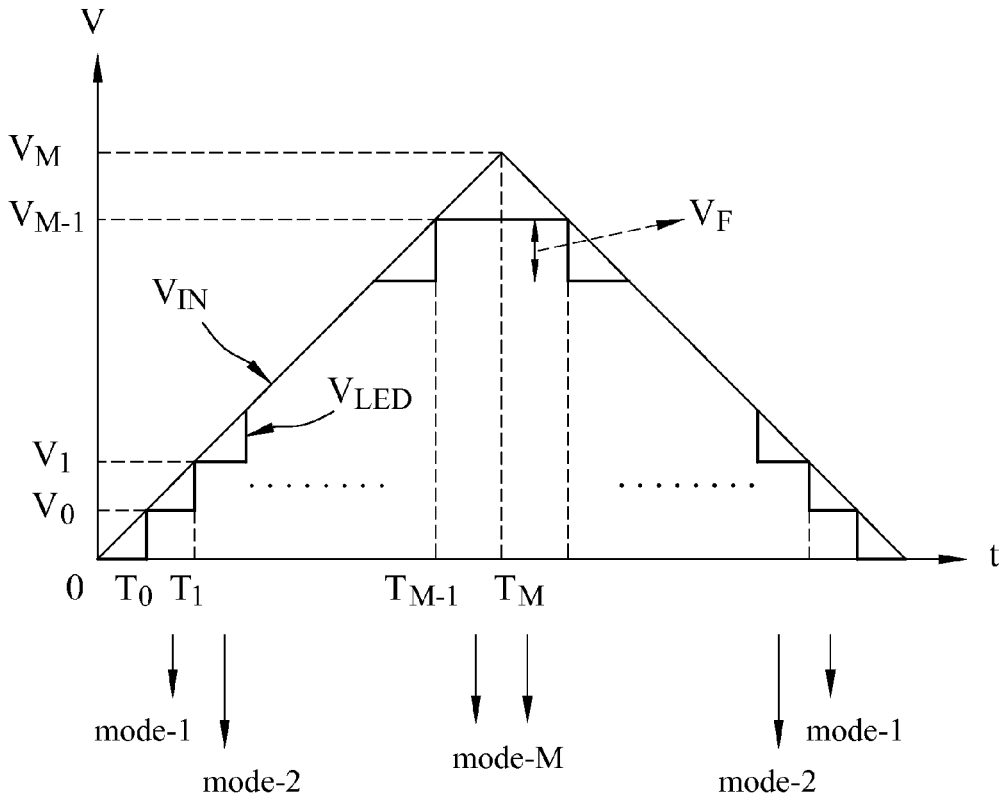
FIG. 2 shows the voltage levels of input voltage $V_{IN}$ and the corresponding voltage $V_{LED}$ of an LED-based lighting apparatus operating in M different lighting modes according to the present invention.

FIG. 2 shows the voltage levels of input voltage $V_{IN}$ and the corresponding voltage $V_{LED}$ of an LED-based lighting apparatus operating in M different lighting modes according to the present invention. An LED is operating at the highest efficiency when the voltage $V_{LED}$ applied to the LED is at the forward voltage $V_F$ of the LED. For an LED-based lighting apparatus having N LEDs, the lighting apparatus can be operated with N LEDs all connected in series if it is driven by a maximum constant current source. In each lighting mode, a desired number of LEDs are connected in series with some LEDs being bypassed. To achieve the highest efficiency for the LED-based lighting apparatus, the following integral should be minimized based on FIG. 2:

$$\int_0^{T_M}(V_{IN}-V_{LED})dt,$$

where $T_M$ is the time when the LED-based lighting apparatus is applied with voltage $V_M$ and operates in mode-M.

Figure 3:
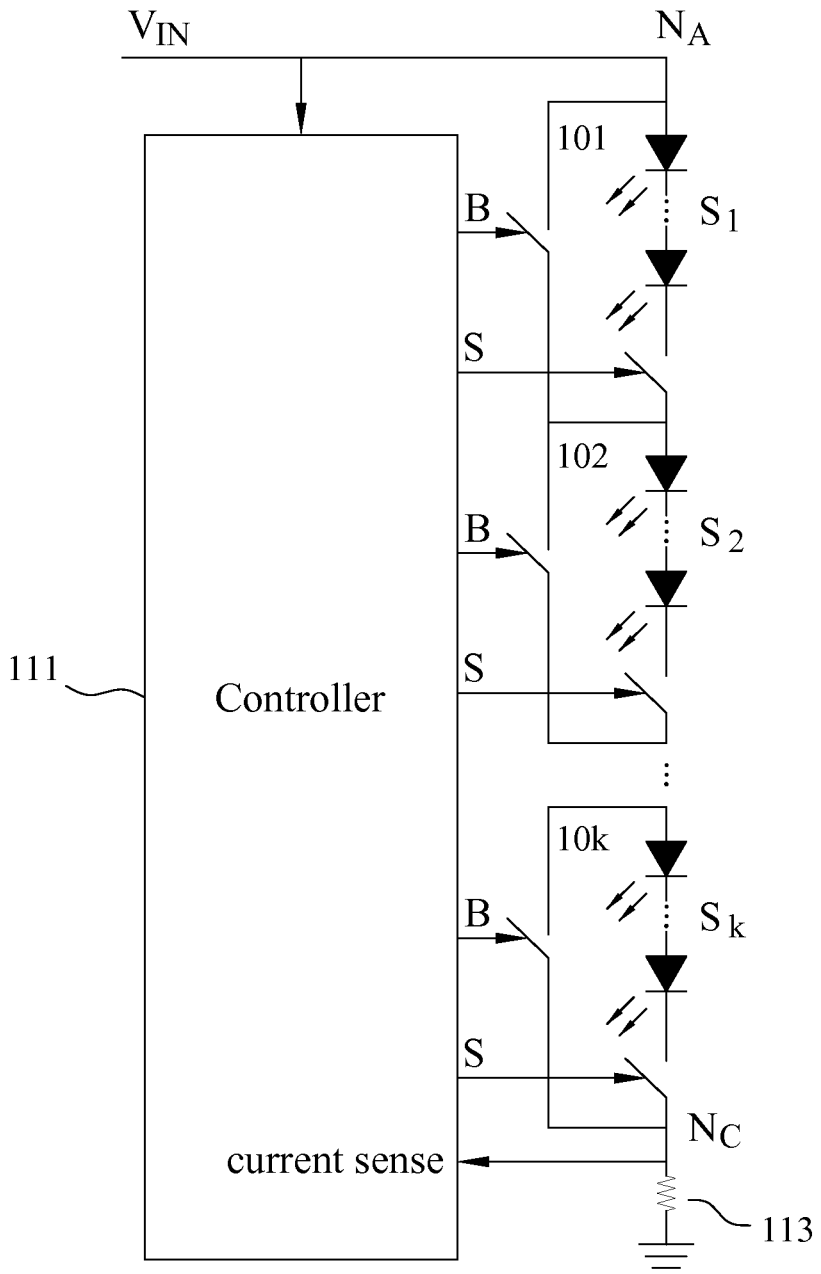
FIG. 3 shows a circuit block diagram of an apparatus for controlling the LED-based lighting segments according to a preferred embodiment of the present invention.

FIG. 3 shows a circuit block diagram of an apparatus for controlling the LED-based lighting segments according to a preferred embodiment of the present invention. The apparatus comprises a plurality of LED-based lighting segments 101, 102, . . . , 10*k* connected between nodes $N_A$ and $N_C$. Input voltage $V_{IN}$ provides power to the plurality of LED-based lighting segments 101~10*k* through node $N_A$ and a current sensing resistor 113 connects node $N_C$ to ground. As pointed out above, it is assumed that each LED-based lighting unit has only one LED. Each lighting segment 101~10*k* includes at least one or more LEDs connected in series. In addition, at least one switch S is connected in series with the series of LEDs in the lighting segment.

As can be seen from FIG. 3, each LED-based lighting segment 101~10*k* has a positive end and a negative end. The positive terminal of the leading LED in each lighting segment is connected to the positive end of the segment. Each LED-based lighting segment 101~10*k* further has a switch B connecting the positive end to the negative end. In FIG. 3, switch S is shown to connect the negative terminal of the trailing LED to the negative end of the segment although switch S can be disposed anywhere in series with the series of LEDs in the segment.

With reference to FIG. 3, it can be seen that when switch S is turned on and switch B is turned off in an LED-based lighting segment, the LEDs in the lighting segment are connected in series with the other lighting segments. When switch B is turned on, the corresponding LED-based lighting segment is short-circuited and the lighting segment becomes bypassed.

In the exemplary embodiment shown in FIG. 3, there are k LED-based lighting segments, the number of LEDs in each lighting segment is $S_1$, $S_2$, . . . , and $S_k$ respectively, and the total number of LEDs is N. The present invention provides a method of segmenting all the available N LEDs into k segments so that the LED-based lighting apparatus can be driven to operate in N different lighting modes for respectively connecting 1, 2, 3, . . . , or N of all the available LEDs in series according to the lighting requirement in practical applications.

In order to achieve the flexibility of connecting 1 to N LEDs from a total of N LEDs, the number of LED-based lighting segments and the number of LEDs in each segment have to satisfy the following conditions according to the present invention:

$$S_1 = 1,\ S_n \le \sum_{i=1}^{n-1} S_i + 1 \text{ for } 2 \le n \le k, \text{ and } S_k = N - \sum_{i=1}^{k-1} S_i.$$

As an example, a total of 11 LEDs can be divided into 4 LED-based lighting segments with $S_1=1$, $S_2=2$, $S_3=3$ and $S_4=5$. With such a segmentation in the LED-based lighting apparatus, 11 lighting modes, $M_1$, $M_2$, . . . , and $M_{11}$ can be obtained by the combination of the LED-based lighting segments being connected in series or bypassed as follows:

$M_1$: $S_1=1$, $M_2$: $S_2=2$, $M_3$: $S_3=3$, $M_4$: $S_1+S_3=4$, $M_5$: $S_4=5$, $M_6$: $S_1+S_4=6$, $M_7$: $S_2+S_4=7$, $M_8$: $S_3+S_4=8$, $M_9$: $S_1+S_3+S_4=9$, $M_{10}$: $S_2+S_3+S_4=10$, and $M_{11}$: $S_1+S_2+S_3+S_4=11$.

In practice, the total number of LEDs in the LED-based lighting apparatus can be determined by the maximum input voltage $V_{IN(max)}$ and the forward voltage $V_F$ of the LED at a maximum current $I_{max}$ for optimal efficiency, i.e., $$N \le \left\lfloor \frac{V_{IN(max)}}{V_F} \right\rfloor,$$

where $$\left\lfloor \frac{V_{IN(max)}}{V_F} \right\rfloor$$

stands for the integer part of the number ($V_{IN(max)}/V_F$). The voltage of current sensing resistor 113 is monitored by a controller 111 as shown in FIG. 3 to ensure that the current flowing through the LEDs is less than or equal to the maximum current $I_{max}$.

If the total number of LEDs in the LED-based lighting apparatus is greater than $$\left\lfloor \frac{V_{IN(max)}}{V_F} \right\rfloor, \text{ i.e.,}$$

$$N \ge \left\lfloor \frac{V_{IN(max)}}{V_F} \right\rfloor + 1,$$

the current flowing through the LEDs can be controlled by the controller 111 to be less than or equal to the maximum current $I_{max}$ without using the current sensing resistor 113. The controller 111 controls the LED-based lighting segments so that only one LED is connected in series when $0 \le V_{IN} \le V_F$, at least two LEDs are connected in series when $V_F < V_{INT} \le 2V_F$, at least three LEDs are connected in series when $2V_F < V_{IN} \le 3V_F$, . . . , at least (N−1) LEDs are connected in series when $(N-2)V_F < V_{IN} \le (N-1)V_F$, and N LEDs are connected in series when $(N-1)V_F < V_{IN} \le V_{IN(max)} \le NV_F$. As a result, the current flowing through the LEDs is always less than or equal to the maximum current $I_{max}$.

According to the present invention, the flexibility of connecting 1 to N LEDs from a total of N LEDs of k LED-based lighting segments can be achieved if the following condition can be satisfied by the number k:

$$\lfloor \log_2 N \rfloor + 1 \le k \le N,$$

where $\lfloor \log_2 N \rfloor$ stands for the integer part of the number $\log_2 N$.

For example, if a rectified AC voltage of 100 volts is used and the forward voltage of the LED is 3.3 volts, the total number of LEDs may be N=42. If the number of LED-based lighting segments k is 6, the condition $\lfloor \log_2 N \rfloor + 1 \le k \le N$ is satisfied. Under this condition, the number of LEDs in each lighting segment can be $S_1=1$, $S_2=2$, $S_3=3$, $S_4=7$, $S_5=14$, and $S_6=15$ for providing the flexibility of 42 lighting modes of connecting 1 to 42 LEDs by various combinations of the LED-based lighting segments.

As another example, if a rectified AC voltage of 110 volts is used and the forward voltage of the LED is 3.3 volts, the total number of LEDs may be N=47. If the number of LED-based lighting segments k is 6, the condition $\lfloor \log_2 N \rfloor + 1 \le k \le N$ is satisfied. Under this condition, the number of LEDs in each lighting segment can be $S_1=1$, $S_2=2$, $S_3=3$, $S_4=7$, $S_5=14$, and $S_6=20$ for providing the flexibility of 47 lighting modes of connecting 1 to 47 LEDs by various combinations of the LED-based lighting segments.

As an alternative example, if a rectified AC voltage of 220 volts is used and the forward voltage of the LED is 3.3 volts, the total number of LEDs may be N=94. If the number of LED-based lighting segments k is 7, the condition $\lfloor \log_2 N \rfloor + 1 \le k \le N$ is satisfied. Under this condition, the number of LEDs in each lighting segment can be $S_1=1$, $S_2=2$, $S_3=3$, $S_4=7$, $S_5=14$, $S_6=28$, and $S_7=39$ for providing the flexibility of 94 lighting modes of connecting 1 to 94 LEDs by various combinations of the LED-based lighting segments.

As another alternative example, if a rectified AC voltage of 240 volts is used and the forward voltage of the LED is 3.3 volts, the total number of LEDs may be N=102. If the number of LED-based lighting segments k is 7, the condition $\lfloor \log_2 N \rfloor + 1 \le k \le N$ is satisfied. Under this condition, the number of LEDs in each lighting segment can be $S_1=1$, $S_2=2$, $S_3=3$, $S_4=7$, $S_5=14$, $S_6=28$, and $S_7=51$ for providing the flexibility of 102 lighting modes of connecting 1 to 102 LEDs by various combinations of the LED-based lighting segments.

It should be noted that the numbers shown above are for the purpose of illustrating the principle of the method in segmenting the number of LEDs in the LED-based lighting apparatus. There are other possible configurations in which different number of lighting segments and different numbers of LEDs in the lighting segments can be used to provide the same flexibility. In addition, the order of the LED-based lighting segments $S_1$, $S_2$, . . . , and $S_k$ in the lighting apparatus shown in FIG. 3 can be flexibly rearranged between node $N_A$ and node $N_C$ without affecting the performance or brightness of the lighting apparatus.

In accordance with the present invention, an alternative method of segmentation can also be used to connect a portion of N LEDs from a total of N LEDs of k LED-based lighting segments. This method has less flexibility as compared to the method described above because some of the lighting modes can not be achieved. However, the number of lighting modes is large enough for practical application. In this method, this number of LED-based lighting segments k must satisfy the following condition:

$$2 \le k \le \lfloor \log_2 N \rfloor,$$

where $\lfloor \log_2 N \rfloor$ stands for the integer part of the number $\log_2 N$.

For example, if a rectified AC voltage of 100 volts is used and the forward voltage of the LED is 3.3 volts, the total number of LEDs may be N=42. If the number of LED-based lighting segments k is 5, the condition $2 \le k \le \lfloor \log_2 N \rfloor$ is satisfied. Under this condition, the number of LEDs in each lighting segment can be $S_1=1$, $S_2=2$, $S_3=5$, $S_4=11$, and $S_5=23$ for providing the flexibility of multiple lighting modes of connecting a portion of 42 LEDs by various combinations of the LED-based lighting segments. The numbers of LEDs that can be connected in series are 1-3, 5-8, 11-14, 16-19, 23-26, 28-31, 34-37 and 39-42.

As another example, if a rectified AC voltage of 110 volts is used and the forward voltage of the LED is 3.3 volts, the total number of LEDs may be N=47. If the number of LED-based lighting segments k is 5, the condition $2 \le k \le \lfloor \log_2 N \rfloor$ is satisfied. Under this condition, the number of LEDs in each lighting segment can be $S_1=1$, $S_2=2$, $S_3=5$, $S_4=12$, and $S_5=27$ for providing the flexibility of multiple lighting modes of connecting a portion of 47 LEDs by various combinations of the LED-based lighting segments. The numbers of LEDs that can be connected in series are 1-3, 5-8, 12-15, 17-20, 27-30, 32-35, 39-42 and 44-47.

As an alternative example, if a rectified AC voltage of 220 volts is used and the forward voltage of the LED is 3.3 volts, the total number of LEDs may be N=94. If the number of LED-based lighting segments k is 6, the condition $2 \le k \le \lfloor \log_2 N \rfloor$ is satisfied. Under this condition, the number of LEDs in each lighting segment can be $S_1=1$, $S_2=2$, $S_3=5$, $S_4=12$, $S_5=25$, and $S_6=49$ for providing the flexibility of multiple lighting modes of connecting a portion of 94 LEDs by various combinations of the LED-based lighting segments. The numbers of LEDs that can be connected in series are 1-3, 5-8, 12-15, 17-20, 25-28, 30-33, 37-40, 42-45, 49-52, 54-57, 61-64, 66-69, 74-77, 79-82, 86-89 and 91-94.

As another alternative example, if a rectified AC voltage of 240 volts is used and the forward voltage of the LED is 3.3 volts, the total number of LEDs may be N=102. If the number of LED-based lighting segments k is 6, the condition $2 \le k \le \lfloor \log_2 N \rfloor$ is satisfied. Under this condition, the number of LEDs in each lighting segment can be $S_1=1$, $S_2=2$, $S_3=5$, $S_4=12$, $S_5=25$, and $S_6=57$ for providing the flexibility of multiple lighting modes of connecting a portion of the 102 LEDs by various combinations of the LED-based lighting segments. The numbers of LEDs that can be connected in series are 1-3, 5-8, 12-15, 17-20, 25-28, 30-33, 37-40, 42-45, 57-60, 62-65, 69-72, 74-77, 82-85, 87-90, 94-97 and 99-102.

According to the present invention, each LED-based lighting segment **101~10*k*** has two different modes of operation. In the first mode of operation, switch B is turned off and switch S is turned on. As a result, all the LEDs in the lighting segment are connected in series. In other words, the LED-based lighting segment is connected in series with other LED-based lighting segments when it is controlled to operate in the first mode.

In the second mode of operation, switch B is turned on. As can be seen from FIG. 3, the LED-based lighting segment is short-circuited by the connection of switch B and no current flows through the LEDs in the short-circuited lighting segment. The LED-based lighting segment is bypassed when it is controlled to operate in the second mode.

According to the present invention, each LED-based lighting segment **101~10*k* in the apparatus is controlled separately. As shown in FIG. 3, the apparatus further comprises the controller 111 that is used to send a respective set of control signals to switch B and switch S of each LED-based lighting segment 101~10*k*. The two control signals can control each LED-based lighting segment to operate in one of the two modes described above. Because each LED-based lighting segment 101~10*k* can be connected in series or bypassed, the plurality of lighting segments 101~10*k* in the apparatus can be controlled in many different lighting modes discussed above using the controller 111**.

In this preferred embodiment, the last lighting segment is connected to one end of the current sensing resistor 113 at node $N_C$. The other end of the current sensing resistor 113 is connected to ground. Node $N_C$ is also connected to the controller 111 so that the voltage level at node $N_C$ can be detected by the controller 111. The plurality of LED-based lighting segments **101~10*k* can be controlled by the controller 111 according to the voltage level across the current sensing resistor 113** at node $N_C$, the voltage level of input voltage $V_{IN}$ supplied to node $N_A$, or the combination of the two voltage levels.

Figure 4:
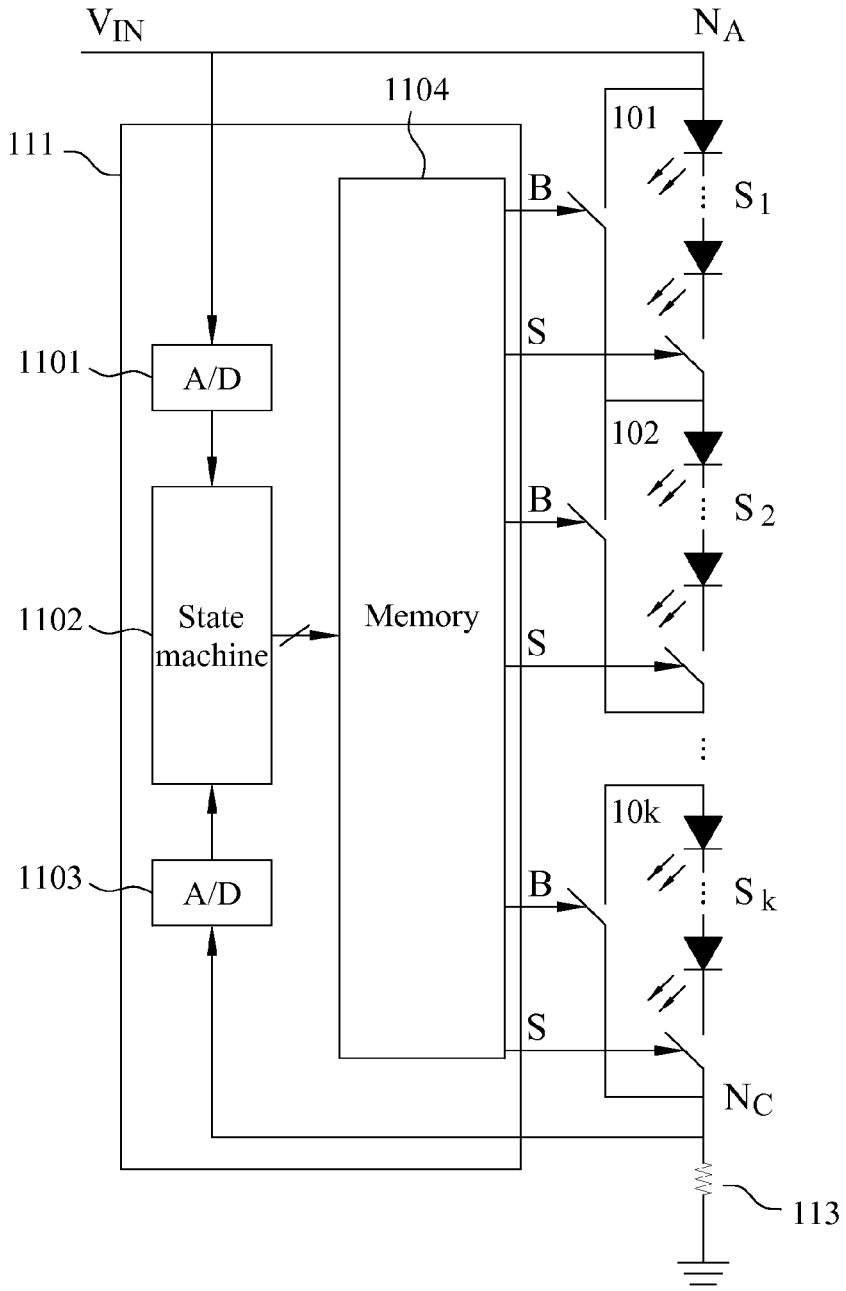
FIG. 4 shows an exemplary block diagram of the controller according to the embodiment shown in FIG. 3.

FIG. 4 shows an exemplary block diagram of the controller 111 according to the embodiment shown in FIG. 3. An A/D converter 1101 in the controller 111 converts input voltage $V_{IN}$ into a digital signal which is sent to a state machine 1102. The voltage level at node $N_C$ is detected by another A/D converter 1103 which also outputs a signal to the state machine 1102. The logic of controlling the plurality of LED-based lighting segments **101~10*k* is implemented in the state machine 1102 along with a memory device 1104** to send control signals to each LED-based lighting segment.

According to the present invention, the LED in the LED-based lighting segment **101~10*k*** refers to all types of light emitting diodes such as semi-conductor and organic light emitting diodes that may emit light at various frequency spectrums. The apparatus may comprise a different number of LED-based lighting segments and each LED-based lighting segment may comprise appropriate number of LED lighting units that can satisfy the conditions described in the segmentation methods of the present invention and meet the requirements in the specific application of the apparatus. Switch B or switch S may be any switching device that can be controlled to connect or disconnect a circuit. The switching devices may be mechanical or electrical, or semiconductor switches implemented with integrated circuits.

Figure 5:
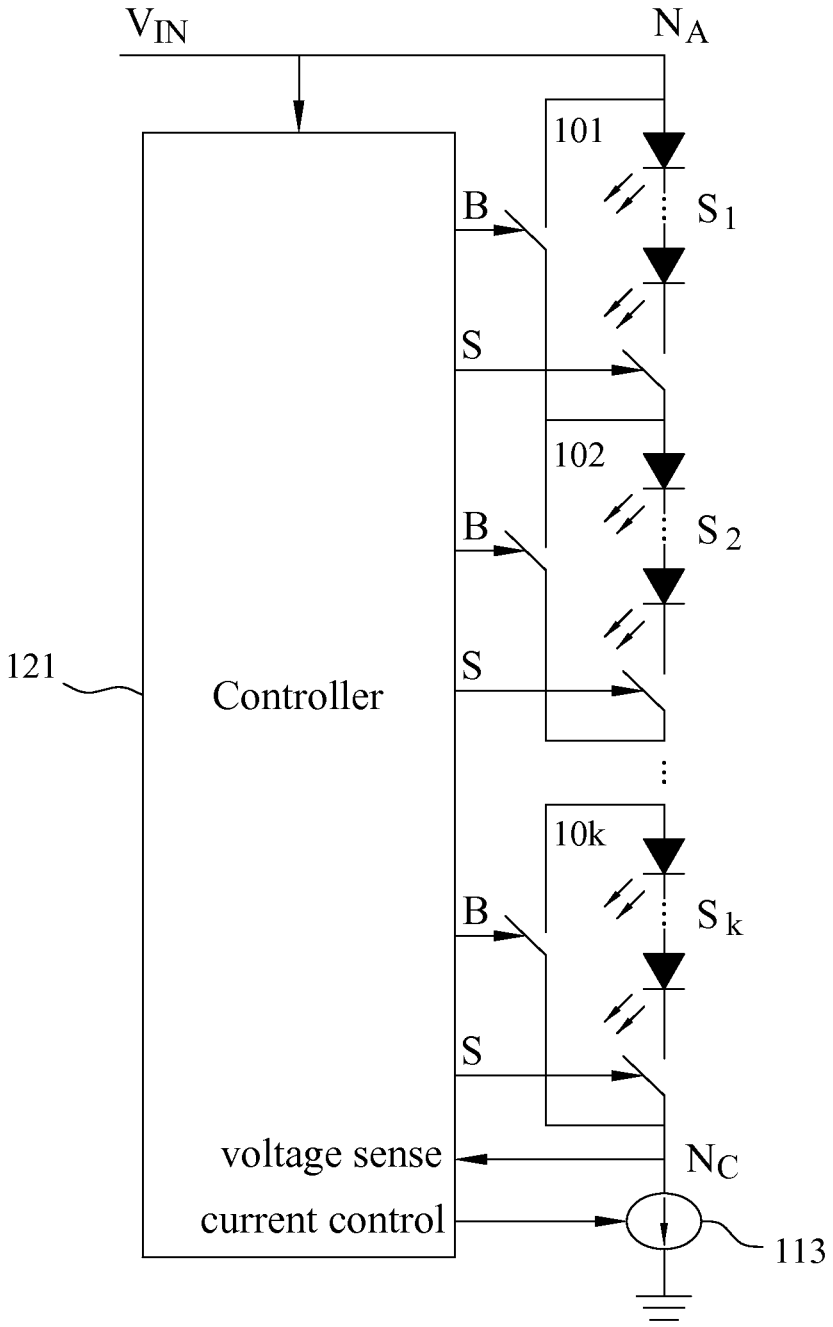
FIG. 5 shows a circuit block diagram of an apparatus for controlling the LED-based lighting segments according to another preferred embodiment of the present invention.

FIG. 5 shows a circuit block diagram of an apparatus for controlling LED-based lighting segments according to another preferred embodiment of the present invention. In this embodiment, the apparatus also comprises a plurality of LED-based lighting segments **101~10*k* connected between node $N_A$ and node $N_C$. The current sensing resistor 113 illustrated in the embodiment of FIG. 3 is replaced by a variable current source 115. A controller 121 controls the current flowing through the variable current source 115 in addition to controlling the plurality of LED-based lighting segments 101~10***k*.

In this embodiment, the voltage level of the variable current source 115 at node $N_C$ is also detectable. The plurality of LED-based lighting segments 101~10*k* can be controlled by the controller 121 according to the voltage level across the variable current source 115 at node $N_C$, the voltage level of the input voltage $V_{IN}$ supplied to node $N_A$, or the combination of the two voltage levels.

Figure 6:
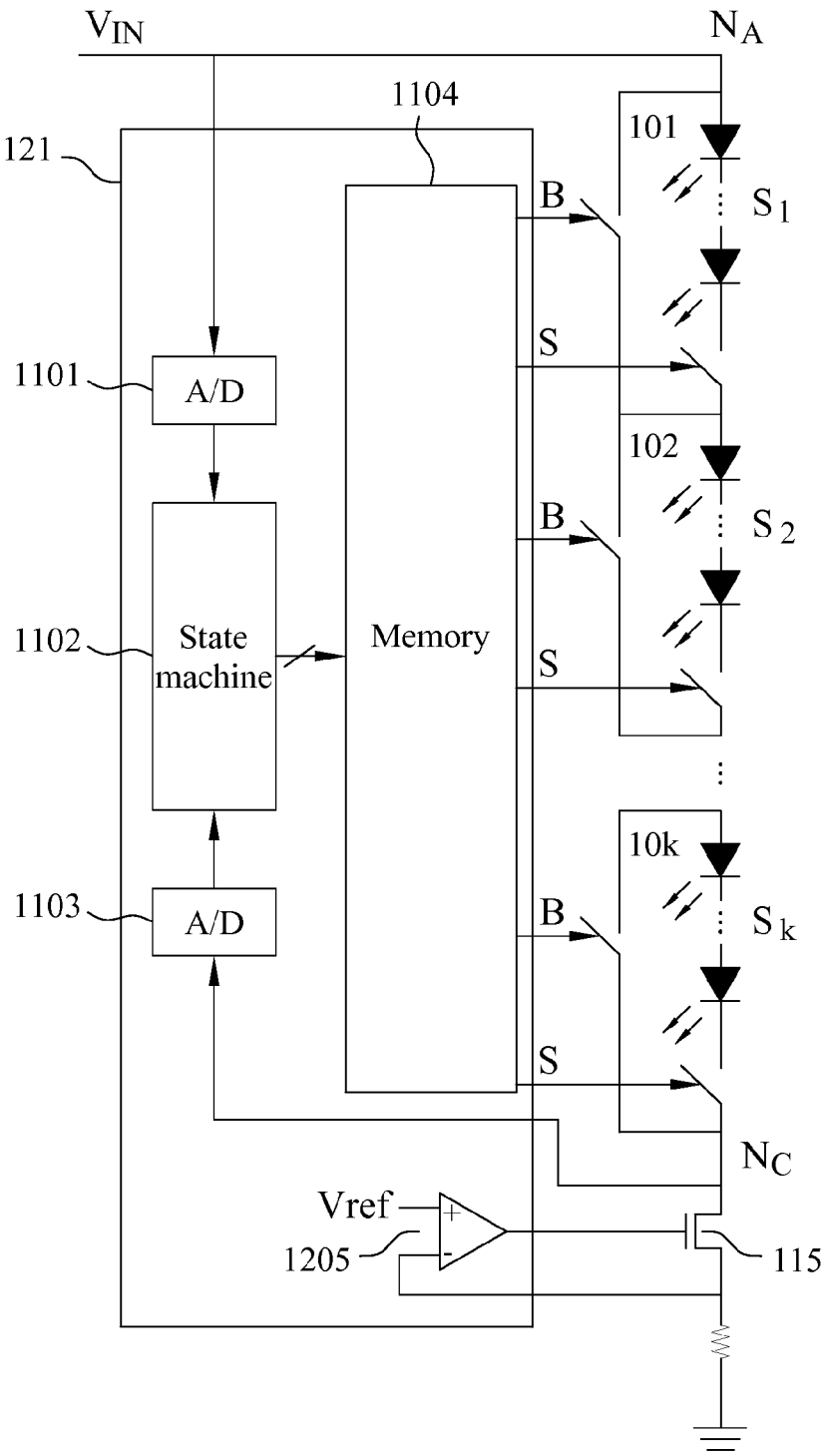
FIG. 6 shows an exemplary block diagram of the controller according to the embodiment of FIG. 5.

FIG. 6 shows an exemplar block diagram of the controller 121 according to the embodiment of FIG. 5. The logic of controlling the plurality of LED-based lighting segments 101~10*k* is implemented in a state machine 1102 along with a memory device 1104 to send separate control signals to switch B and switch S of each LED-based lighting segment. An A/D converter 1101 in the controller 121 converts input voltage $V_{IN}$ into a digital signal which is sent to the state machine 1102. The voltage level at node $N_C$ is detected by another A/D converter 1103 which also outputs a digital signal to the state machine 1102. A current control circuit 1205 controls the variable current source 115.

Figure 7:
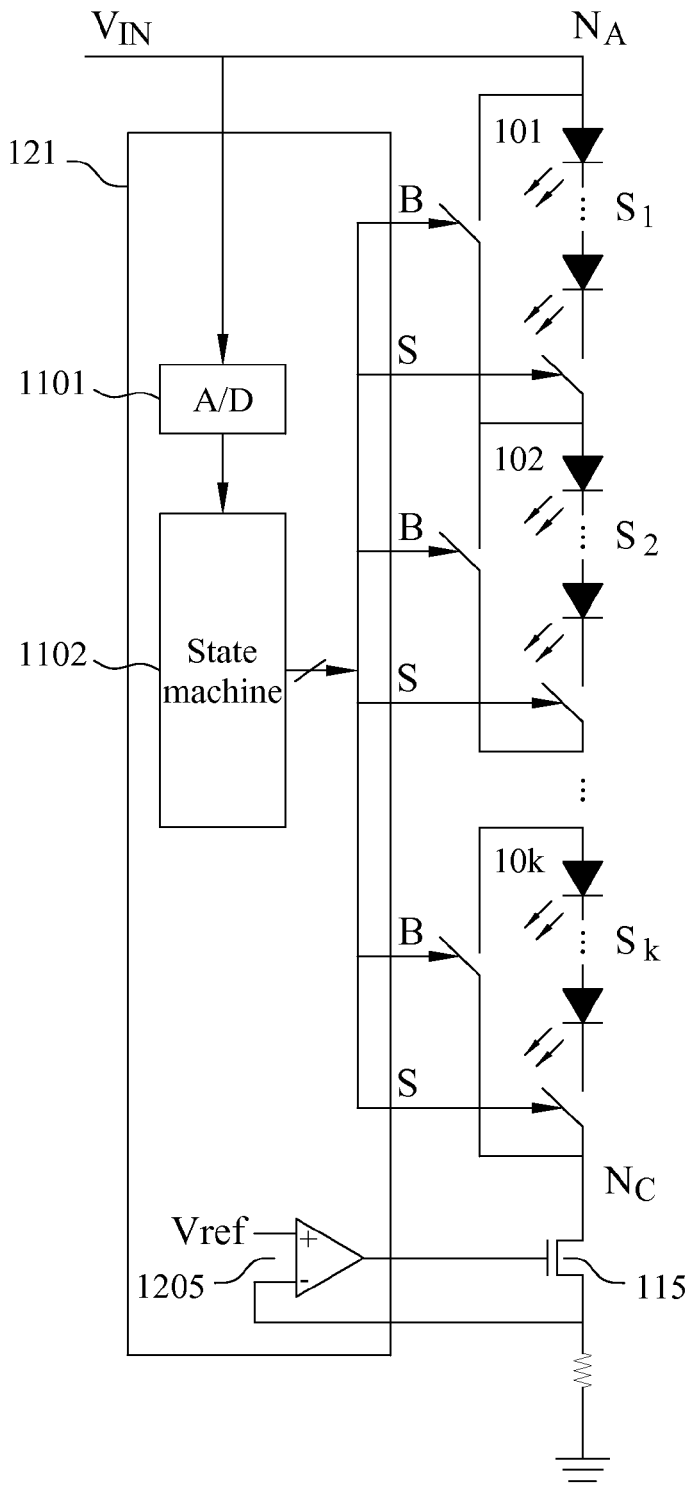
FIG. 7 shows another exemplary block diagram of the controller according to the embodiment of FIG. 5.

FIG. 7 shows another exemplar block diagram of the controller 121 according to the embodiment of FIG. 5. The logic of controlling the plurality of LED-based lighting segments 101~10*k* is implemented in a state machine 1102 to send separate control signals to switch B and switch S of each LED-based lighting segment. No memory device is needed in this implementation of the controller 121. An A/D converter 1101 in the controller 121 converts input voltage $V_{IN}$ into a digital signal which is sent to the state machine 1102. A current control circuit 1205 controls the variable current source 115.

Figure 8:
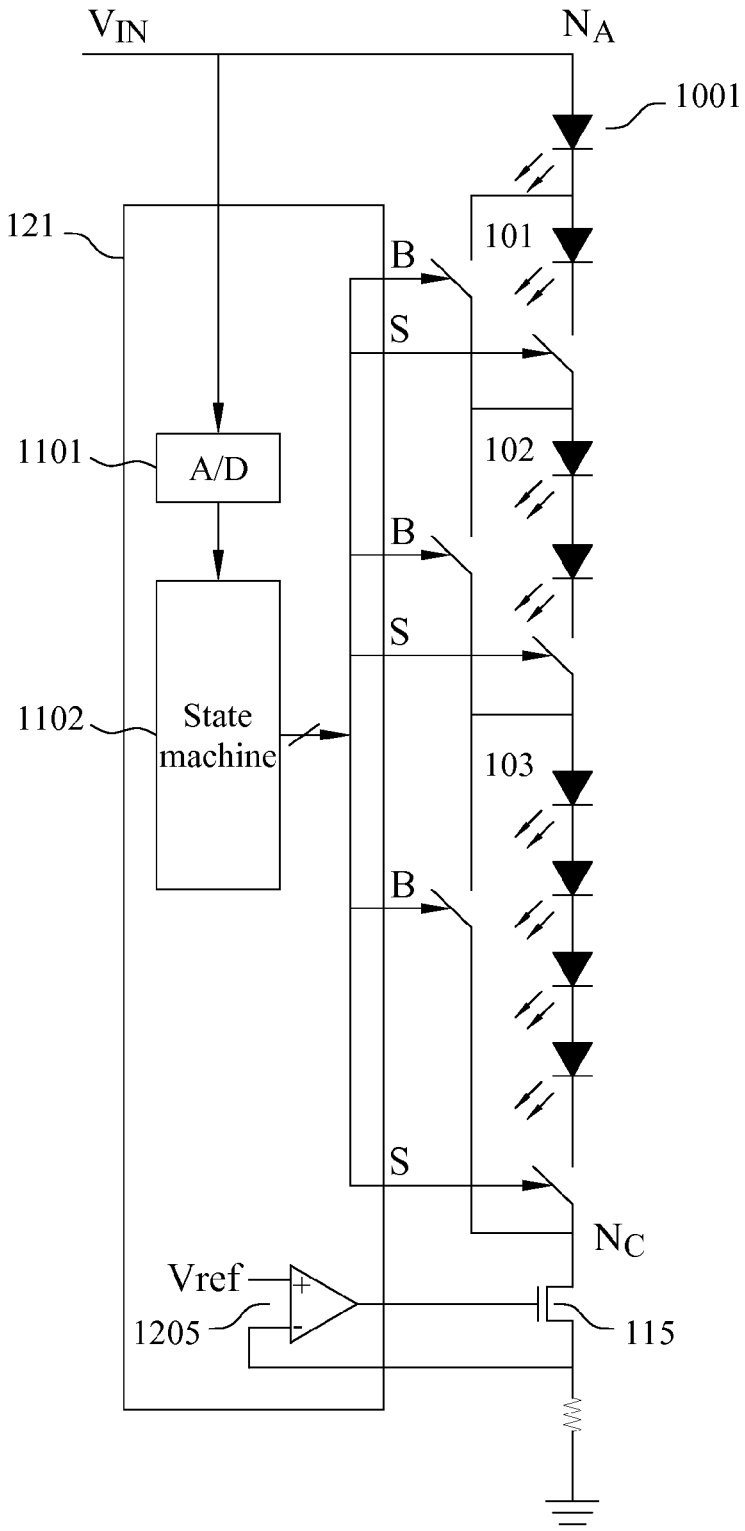
FIG. 8 shows a circuit block diagram for an example of LED-based lighting segments according to a variation of the embodiment of FIGS. 5 and 7.

FIG. 8 shows a circuit block diagram of an apparatus for controlling LED-based lighting segments according to a variation of the embodiment of FIGS. 5 and 7. In this variation, the apparatus also comprises a plurality of LED-based lighting segments 101~103 connected in series. An LED 1001 is connected between node $N_A$ and the first LED-based lighting segment 101. The remaining circuit is similar to the circuit shown in FIG. 7 with three LED-based lighting segments comprising 1, 2 and 4 LEDs respectively. The LED-based lighting apparatus of this circuit can provide 8 different lighting modes for connecting 1 to 8 LEDs according to the brightness requirement.

Figure 9:
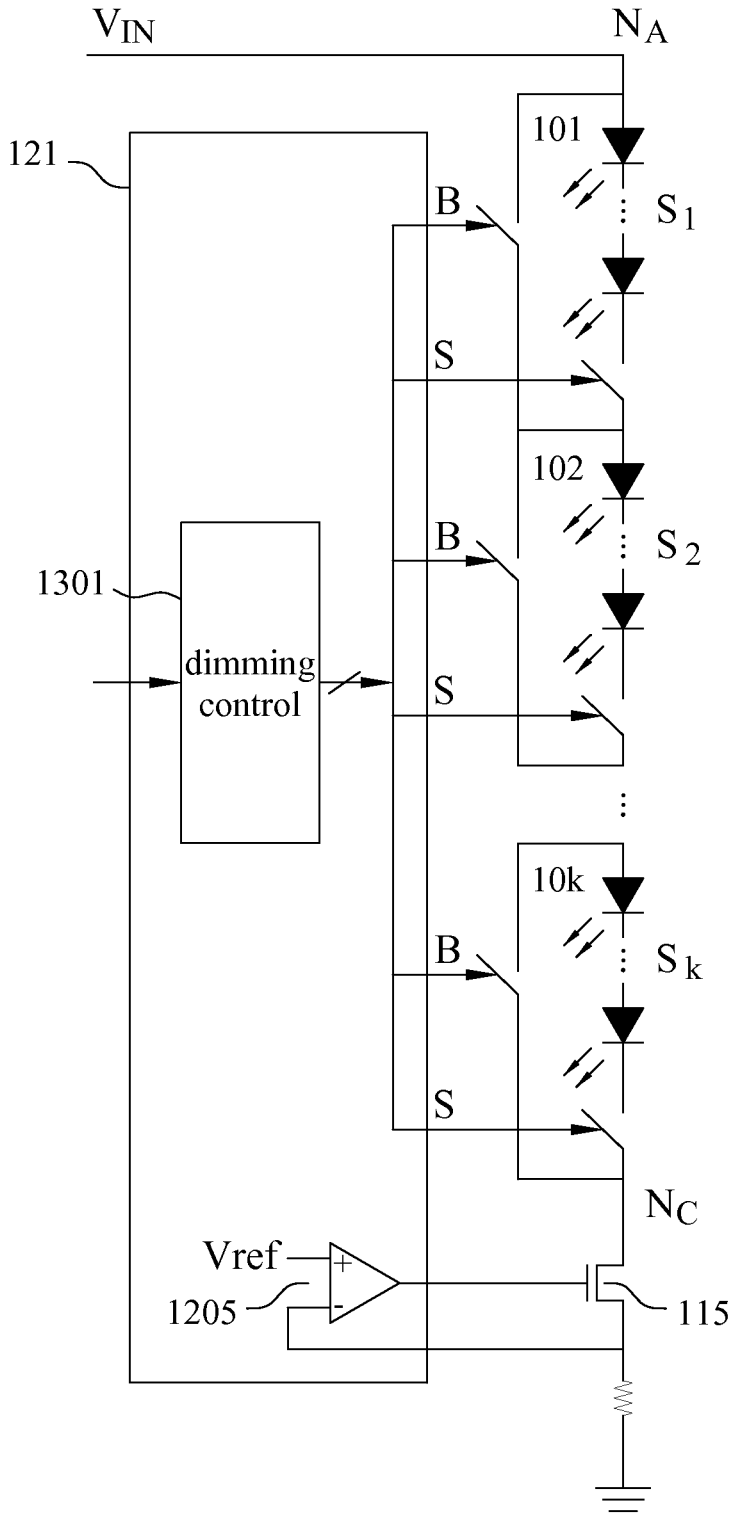
FIG. 9 shows a dimming control unit being used as the controller according to the embodiment of FIG. 5.

FIG. 9 shows an alternative exemplar block diagram of the controller 121 according to the embodiment of FIG. 5. The logic of controlling the plurality of LED-based lighting segments 101~10*k* is implemented in a dimming control unit 1301 to send separate control signals to switch B and switch S of each LED-based lighting segment. The dimming control unit 1301 can be loaded with different control codes that control the operating modes of each LED-based lighting segment to provide different luminous intensity according to different brightness requirement. A current control circuit 1205 controls the variable current source 115.

Figure 10:
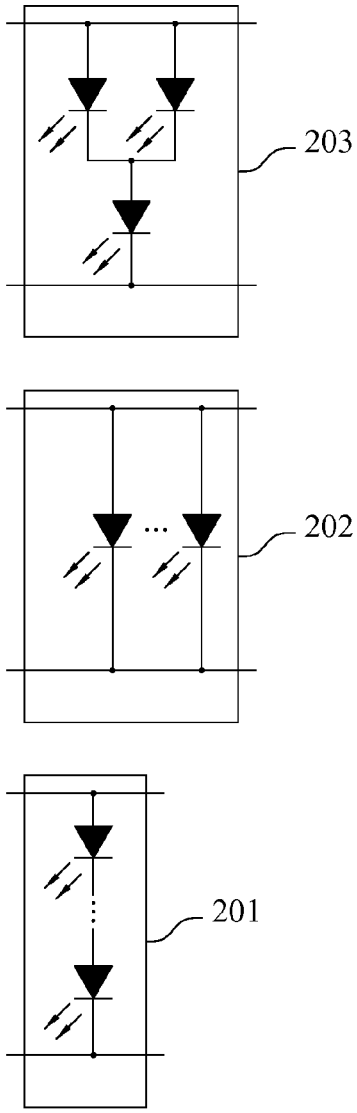
FIG. 10 illustrates that each of the LED-based lighting unit may have at least one LED connected in series, parallel or their combination.

In summary, the present invention provides an apparatus for controlling and connecting a plurality of LED-based lighting segments in which some can be connected in series and some can be bypassed. Each LED-based lighting segment includes one or more LED-based lighting units connected in series, and each LED-based lighting unit may comprise one or more LEDs connected in series 201, parallel 202 or their combination 203 as shown in FIG. 10. Although only three examples are shown in FIG. 10, it should be noted that the LEDs can be connected in many different ways to serve as a lighting unit of the present invention. By using the segmentation methods of the present invention, many different lighting modes can be provided for the LED-based lighting segments to connect a flexible number of LEDs for various luminous requirements.

Although the present invention has been described with reference to the preferred embodiments thereof, it is apparent to those skilled in the art that a variety of modifications and changes may be made without departing from the scope of the present invention which is intended to be defined by the appended claims.

What is claimed is:

1. An apparatus for segmenting and driving LED-based lighting units, comprising:

a plurality of LED-based lighting segments connected in series, each of said LED-based lighting segments having a positive end, a negative end, a bypass-connection switch connecting said positive end to said negative end, and one or more LED-based lighting units connected in series with at least a series-connection switch between said positive end and said negative end;

an input voltage supply coupled to said plurality of LED-based lighting segments; and a controller for controlling said plurality of LED-based lighting segments;

wherein each of said plurality of LED-based lighting segments is separately controlled by said controller and comprises a series-connection mode for being connected in series with other LED-based lighting segments, and a bypassed mode for being short-circuited.

2. The apparatus as claimed in claim 1, wherein said controller has a respective pair of control signals connected to each of said plurality of LED-based lighting segments for turning on said bypass-connection switch of the LED-based lighting segment in said bypassed mode, and turning off said bypass-connection switch and turning on said series-connection switch of the LED-based lighting segment in said series-connection mode.

3. The apparatus as claimed in claim 1, further comprising a current control device connected in series with said plurality of LED-based lighting segments.

4. The apparatus as claimed in claim 3, wherein said current control device sends a voltage level to said controller and said controller controls each of said plurality of LED-based lighting segments to respectively operate in said series-connection mode or said bypassed mode according to said voltage level.

5. The apparatus as claimed in claim 4, wherein said controller controls each of said plurality of LED-based lighting segments to respectively operate in said series-connection mode or said bypassed mode according to a voltage level of said input voltage supply and said voltage level sent by said current control device.

6. The apparatus as claimed in claim 3, wherein said controller comprises a state machine, a first A/D converter for converting a voltage level of said input voltage supply to a first digital signal sent to said state machine, a second A/D converter for converting a voltage level of said current control device to a second digital signal sent to said state machine, and a memory device connected to said state machine for sending a respective pair of control signals to each of said plurality of LED-based lighting segments for turning on said bypass-connection switch of the LED-based lighting segment in said bypassed mode, and turning off said bypass-connection switch and turning on said series-connection switch of the LED-based lighting segment in said series-connection mode.

7. The apparatus as claimed in claim 3, wherein said current control device is a current sensing resistor.

8. The apparatus as claimed in claim 3, wherein said current control device is a variable current source controlled by said controller.

9. The apparatus as claimed in claim 3, wherein said apparatus comprises a total of N LED-based lighting units with $$N \le \left\lfloor \frac{V_{IN(max)}}{V_F} \right\rfloor,$$

$V_{IN(max)}$ being a maximum input voltage of said input voltage supply, $V_F$ being a forward voltage of each LED-based lighting unit at a maximum current $I_{max}$ limited by said current control device, and $$\left\lfloor \frac{V_{IN(max)}}{V_F} \right\rfloor$$

being an integer part of $(V_{IN(max)}/V_F)$.

10. The apparatus as claimed in claim 1, wherein said apparatus comprises a total of N LED-based lighting units with $$N \ge \left\lfloor \frac{V_{IN(max)}}{V_F} \right\rfloor + 1,$$

$V_{IN(max)}$ being a maximum input voltage of said input voltage supply, $V_F$ being a forward voltage of each LED-based lighting unit at a maximum current $I_{max}$ controlled by said controller, and $$\left\lfloor \frac{V_{IN(max)}}{V_F} \right\rfloor$$

being an integer part of $(V_{IN(max)}/V_F)$.

11. The apparatus as claimed in claim 10, wherein $V_{IN}$ is an input voltage of said input voltage supply and said controller controls said plurality of LED-based lighting segments so that only one of said LED-based lighting units is connected in series when $0 \le V_{IN} \le V_F$, at least two of said LED-based lighting units are connected in series when $V_F < V_{IN} \le 2V_F$, at least three of said LED-based lighting units are connected in series when $2V_F < V_{IN} \le 3V_F, \ldots$, at least (N−1) of said LED-based lighting units are connected in series when $(N-2)V_F < V_{IN} \le (N-1)V_F$, and N of said LED-based lighting units are connected in series when $(N-1)V_F < V_{IN} \le V_{IN(max)} \le NV_F$.

12. The apparatus as claimed in claim 1, wherein said apparatus comprises a total of N LED-based lighting units segmented into k LED-based lighting segments respectively having $S_1, S_2, \ldots$, and $S_k$ LED-based lighting units with k being an integer number greater than 3, $\lfloor \log_2 N \rfloor + 1 \le k \le N$, $\lfloor \log_2 N \rfloor$ being an integer part of $\log_2 N$, and $S_1, S_2, \ldots$, and $S_k$ are integer numbers with $$S_1 = 1, S_n \le \sum_{i=1}^{n-1} S_i + 1$$

for $2 \le n \le k$, and $$S_k = N - \sum_{i=1}^{k-1} S_i.$$

13. The apparatus as claimed in claim 1, wherein said apparatus comprises a total of N LED-based lighting units segmented into k LED-based lighting segments respectively having $S_1, S_2, \ldots$, and $S_k$ LED-based lighting units with k being an integer number, $3 < k \le \lfloor \log_2 N \rfloor$, $\lfloor \log_2 N \rfloor$ being an integer part of $\log_2 N$, and $S_1, S_2, \ldots$, and $S_k$ are integer numbers with $$\sum_{i=1}^{k} S_i = N.$$

14. The apparatus as claimed in claim 1, wherein said controller comprises a dimming control unit for sending a respective pair of control signals to each of said plurality of LED-based lighting segments for turning on said bypass-connection switch of the LED-based lighting segment in said bypassed mode, and turning off said bypass-connection switch and turning on said series-connection switch of the LED-based lighting segment in said series-connection mode.

15. The apparatus as claimed in claim 1, wherein said controller comprises a state machine for sending a respective pair of control signals to each of said plurality of LED-based lighting segments for turning on said bypass-connection switch of the LED-based lighting segment in said bypassed mode, and turning off said bypass-connection switch and turning on said series-connection switch of the LED-based lighting segment in said series-connection mode, an A/D converter for converting a voltage level of said input voltage supply to a digital signal sent to said state machine.

16. The apparatus as claimed in claim 1, wherein said apparatus further comprises an uncontrolled LED-based lighting unit connected in series with said plurality of LED-based lighting segments.

17. The apparatus as claimed in claim 1, wherein each of said plurality of LED-based lighting units comprises one or more LEDs connected in series.

18. The apparatus as claimed in claim 1, wherein each of said plurality of LED-based lighting units comprises a plurality of LEDs connected in parallel.

19. The apparatus as claimed in claim 1, wherein each of said plurality of LED-based lighting units comprises a plurality of LEDs connected in a combination of parallel and series connections.

20. The apparatus as claimed in claim 1, wherein said controller controls each of said plurality of LED-based lighting segments to respectively operate in said series-connection mode or said bypassed mode according to a voltage level of said input voltage supply.

21. A method for segmenting and driving LED-based lighting units, comprising the steps of:

segmenting a total of N LED-based lighting units into k LED-based lighting segments respectively having $S_1, S_2, \ldots$, and $S_k$ LED-based lighting units connected in series between a positive end and a negative end of the respective LED-based lighting segment, each of said LED-based lighting units having a forward voltage $V_F$ at a maximum current $I_{max}$;

coupling an input voltage supply to said plurality of LED-based lighting segments, said input voltage supply having a maximum voltage level $V_{IN(max)}$; and sending a respective pair of control signals to each of said plurality of LED-based lighting segments to respectively connect the corresponding LED-based lighting segment in series or respectively bypass the corresponding LED-based lighting segment;

wherein k is an integer number greater than 3, $\lfloor \log_2 N \rfloor + 1 \leq k \leq N$, $\lfloor \log_2 N \rfloor$ being an integer part of $\log_2 N$, and $S_1, S_2, \ldots$, and $S_k$ are integer numbers with $$S_1 = 1,\ S_n \leq \sum_{i=1}^{n-1} S_i + 1$$

for $2 \leq n \leq k$, and $$S_k = N - \sum_{i=1}^{k-1} S_i.$$

22. The method as claimed in claim 21, further connecting a current control device in series with said plurality of LED-based lighting segments.

23. The method as claimed in claim 22, $$N \leq \left\lfloor \frac{V_{IN(max)}}{V_F} \right\rfloor,$$

said maximum current $I_{max}$ being limited by said current control device, and $$\left\lfloor \frac{V_{IN(max)}}{V_F} \right\rfloor$$

being an integer part of $(V_{IN(max)}/V_F)$.

24. The method as claimed in claim 21, $$N \geq \left\lfloor \frac{V_{IN(max)}}{V_F} \right\rfloor + 1,$$

said maximum current $I_{max}$ being controlled by said controller, and $$\left\lfloor \frac{V_{IN(max)}}{V_F} \right\rfloor$$

being an integer part of $(V_{IN(max)}/V_F)$.

25. The method as claimed in claim 24, wherein $V_{IN}$ is an input voltage of said input voltage supply and said controller controls said plurality of LED-based lighting segments so that only one of said LED-based lighting units is connected in series when $0 \leq V_{IN} \leq V_F$, at least two of said LED-based lighting units are connected in series when $V_F < V_{IN} \leq 2V_F$, at least three of said LED-based lighting units are connected in series when $2V_F < V_{IN} \leq 3V_F, \ldots$, at least (N−1) of said LED-based lighting units are connected in series when $(N-2)V_F < V_{IN} \leq (N-1)V_F$, and N of said LED-based lighting units are connected in series when $(N-1)V_F < V_{IN} \leq V_{IN(max)} \leq NV_F$.

26. A method for segmenting and driving LED-based lighting units, comprising the steps of:

segmenting a total of N LED-based lighting units into k LED-based lighting segments respectively having $S_1, S_2, \ldots$, and $S_k$ LED-based lighting units connected in series between a positive end and a negative end of the respective LED-based lighting segment, each of said LED-based lighting units having a forward voltage $V_F$ at a maximum current $I_{max}$;

coupling an input voltage supply to said plurality of LED-based lighting segments, said input voltage supply having a maximum voltage level $V_{IN(max)}$; and sending a respective pair of control signals to each of said plurality of LED-based lighting segments to respectively connect the corresponding LED-based lighting segment in series or respectively bypass the corresponding LED-based lighting segment;

wherein k is an integer number with $3 < k \leq \lfloor \log_2 N \rfloor$, $\lfloor \log_2 N \rfloor$ being an integer part of $\log_2 N$, and $S_1, S_2, \ldots$, and $S_k$ are integer numbers with $$\sum_{i=1}^{k} S_i = N.$$

27. The method as claimed in claim 26, further connecting a current control device in series with said plurality of LED-based lighting segments.

28. The method as claimed in claim 27, $$N \leq \left\lfloor \frac{V_{IN(max)}}{V_F} \right\rfloor,$$

said maximum current $I_{max}$ being limited by said current control device, and $$\left\lfloor \frac{V_{IN(max)}}{V_F} \right\rfloor$$

being an integer part of $(V_{IN(max)}/V_F)$.

29. The method as claimed in claim 26, $$N \geq \left\lfloor \frac{V_{IN(max)}}{V_F} \right\rfloor + 1,$$

said maximum current $I_{max}$ being controlled by said controller, and $$\left\lfloor \frac{V_{IN(max)}}{V_F} \right\rfloor$$

being an integer part of $(V_{IN(max)}/V_F)$.

30. The method as claimed in claim 29, wherein $V_{IN}$ is an input voltage of said input voltage supply and said controller controls said plurality of LED-based lighting segments so that only one of said LED-based lighting units is connected in series when $0 \leq V_{IN} \leq V_F$, at least two of said LED-based lighting units are connected in series when $V_F < V_{IN} \leq 2V_F$, at least three of said LED-based lighting units are connected in series when $2V_F < V_{IN} \leq 3V_F, \ldots$, at least (N−1) of said LED-based lighting units are connected in series when $(N-2)V_F<V_{IN}\leq(N-1)V_F$, and N of said LED-based lighting units are connected in series when $(N-1)V_F<V_{IN}\leq V_{IN(max)}\leq NV_F$.

* * * * *